US005143230A

United States Patent [19]

LaCorte

[11] Patent Number: 5,143,230

[45] Date of Patent: Sep. 1, 1992

[54] HOLDER FOR HOUSEHOLD WRAP CARTONS

[76] Inventor: Richard LaCorte, 7029 N. Tahoma, Chicago, Ill. 60646

[21] Appl. No.: 638,051

[22] Filed: Jan. 3, 1991

[51] Int. Cl.[5] ..... A47G 29/00

[52] U.S. Cl. ..... 211/71; 108/111; 242/208; 242/55.53

[58] Field of Search ..... 211/186, 88, 74, 71; 242/208, 55.3, 55.53; 108/107, 108, 111; 248/500, 505

[56] References Cited

U.S. PATENT DOCUMENTS

| | | | |
|---|---|---|---|
| 420,761 | 2/1890 | Bittendorf | 211/41 X |
| 906,347 | 12/1908 | Willner | 235/77 |
| 1,620,313 | 3/1927 | Abele | 211/71 |
| 1,700,976 | 2/1929 | Bucman | 211/71 |
| 1,716,964 | 6/1929 | Kuck | 211/71 |
| 1,743,837 | 1/1930 | Vance | 108/111 |
| 2,056,572 | 10/1936 | Gibbs | 225/38 |
| 2,360,978 | 10/1944 | Putter | 211/74 |
| 2,657,873 | 11/1953 | Dittman et al. | 225/77 |
| 2,819,851 | 1/1958 | Robertson | 225/77 |
| 2,969,169 | 1/1961 | Botnick | 225/77 |
| 2,990,090 | 6/1961 | Catlett | 225/77 |
| 3,278,149 | 10/1966 | Brucker | 211/208 |
| 3,549,019 | 12/1970 | Wood | 211/186 X |
| 3,603,519 | 9/1971 | Brown | 242/55.3 |
| 3,661,271 | 5/1972 | Fisher et al. | 211/88 |
| 3,870,155 | 3/1975 | Galloway | 211/74 |
| 4,094,416 | 6/1978 | Smith | 225/42 |
| 4,151,803 | 5/1979 | Ferrera et al. | 108/111 X |
| 4,408,812 | 10/1983 | Krautwurst | 108/108 X |
| 4,582,003 | 4/1986 | Valero | 108/111 |
| 4,806,895 | 2/1989 | Petrow | 248/500 X |

*Primary Examiner*—Carl D. Friedman
*Assistant Examiner*—Korie H. Chan
*Attorney, Agent, or Firm*—Rockey and Rifkin

[57] ABSTRACT

The wrap holder consists of a pair of identical sidewalls having a plurality of slots arranged in pairs formed therein. Extending between the sidewalls and engaging the slots are a plurality of support members. Each support member includes a flange that engages the slot to create a fiction fit between the support members and sidewalls such that the support members can be moved relative to the sidewalls to retain cartons of various sizes between adjacent support members. The support members include V-shaped recesses which engage opposed corners of the cartons to secure the cartons in a position from which the wrap can be dispensed.

5 Claims, 1 Drawing Sheet

HOLDER FOR HOUSEHOLD WRAP CARTONS

BACKGROUND OF THE INVENTION

The invention relates, generally, to a holder for organizing household wrap cartons.

Household wraps such as aluminum foil, wax paper, plastic wrap, and plastic sandwich and garbage bags are typically sold in cartons consisting of rectangular cardboard boxes from which the wrap can be dispensed. Moreover, cartons that contain wraps which are sold in continuous rolls, such as aluminum foil and wax paper, are provided with serrated cutting edges for separating a desired length of wrap from the roll.

While such cartons have proved to be an effective and inexpensive way of packaging and dispensing household wraps, they are difficult to store in an orderly manner. As a result, numerous devices have been designed for organizing household wraps. However, the known prior art devices are relatively difficult and expensive to manufacture and cumbersome to use.

An example of such a prior art device is disclosed in U.S. Pat. No. 4,094,416 issued to Smith. Smith discloses a support for dispensing packages consisting of a panel that can be attached to a wall or to the inside of a kitchen cabinet door. The panel supports a plurality of two-way adjustable holders for accommodating packages of various sizes. Each of the holders consists of a plurality of brackets secured to one another by a fastener and slot arrangement such that the brackets can be adjusted to retain packages of various sizes. As is evident from Smith, the number of parts and the complexity of the assembly and operation of the support make it expensive to manufacture and cumbersome to use.

Another example of a wrap dispenser is disclosed in U.S. Pat. No. 2,969,169 issued to Botnick. Unlike the support disclosed in Smith, the dispenser of Botnick supports the role rather than the carton. As a result, serrated cutting edges must be provided to sever the dispensed length of wrap from the roll. Moreover, a complex support mechanism is provided to hold the roll. Thus, the Botnick device is relatively expensive to manufacture. Moreover, the device disclosed in Botnick is cumbersome to use because the rolls must be removed from the cartons and installed in the roller support.

Thus a holder for organizing and supporting household wrap cartons that is inexpensive to manufacture and simple to use is desired.

BRIEF DESCRIPTION OF THE INVENTION

The wrap holder of the invention overcomes the above-noted shortcomings of the prior art and consists of a pair of identical sidewalls having a plurality of elongated slots arranged in pairs formed therein. Extending between the sidewalls and engaging the elongated slots are a plurality of support members. Each support member includes flanges that engage the slots formed in the sidewalls to create a friction fit between the support member and sidewalls. The support members also have a V-shaped recess formed therein to engage one corner of a carton. The support members are arranged in opposed pairs with the V-shaped recesses facing one another such that one wrap carton is secured between each pair of support members. The support members can be slid in the slots relative to the sidewalls to vary the distance between the support members such that cartons of various sizes can be retained. Because the sidewalls are identical to one another and the horizontal bracing members are also identical to one another, the entire wrap holder of the invention is constructed from only two different components. Moreover, because a friction fit is used to assemble the wrap holder, no separate fasteners are required. As a result, the wrap holder of the invention is inexpensive to manufacture and simple to assemble and use.

OBJECTS OF THE INVENTION

It is a general object of the invention to provide an improved holder for household wrap cartons.

It is a further object of the invention to provide a wrap holder that is inexpensive to manufacture.

It is another object of the invention to provide a household wrap holder that simple to use.

Other objects of the invention, in addition to those set forth above, will become apparent from the following detailed description of the invention.

DETAILED DESCRIPTION OF THE INVENTION

Figure 1:
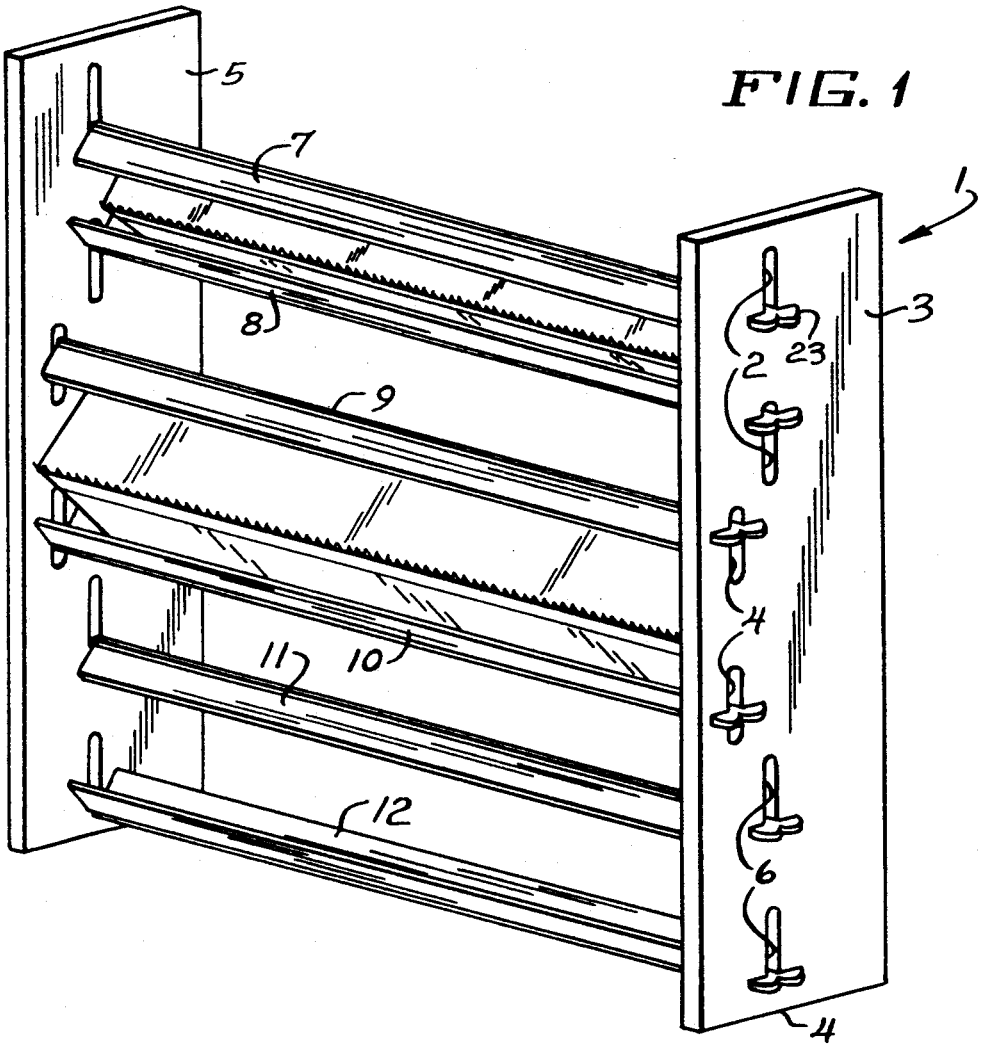
FIG. 1 shows a perspective view of the household wrap carton holder of the invention.
Figure 2:
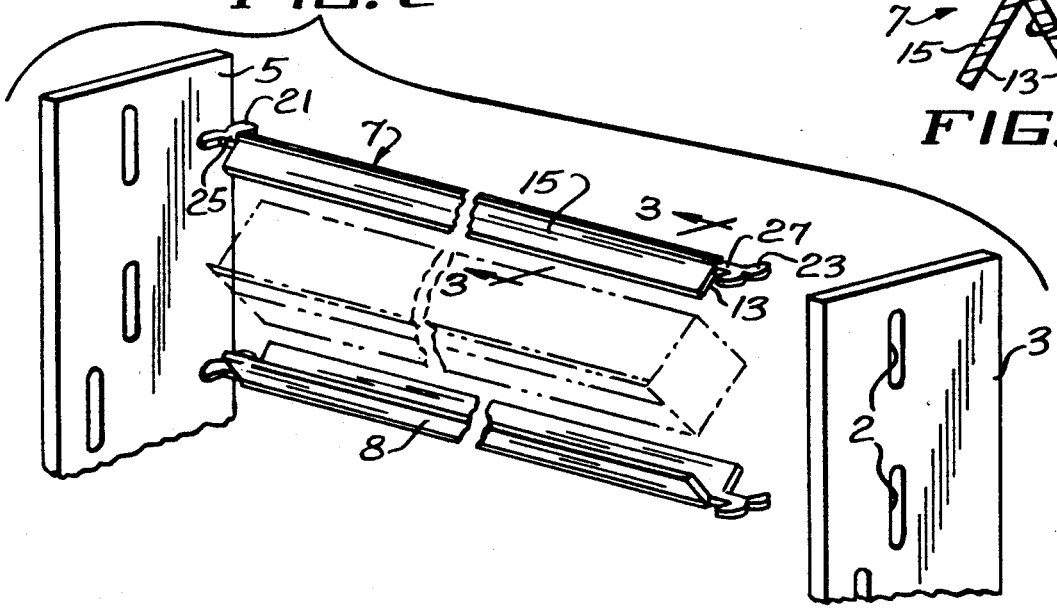
FIG. 2 shows an exploded view of the carton holder of FIG. 1.

Referring more particularly to FIGS. 1 and 2 the carton holder of the invention is shown generally at 1 and consists of a pair of identical sidewalls 3 and 5. Because sidewalls 3 and 5 are identical, specific reference will be made only to sidewall 3, it being understood that the construction, function and operation of sidewall 5 is identical thereto. Sidewall 3 consists of a flat piece of extruded plastic having a bottom edge 4 that can support the wrap holder 1 in free standing position on a horizontal surface. Sidewall 3 can also be secured to a vertical wall using suitable fasteners if desired. Sidewall 3 includes a plurality of elongated slots arranged in pairs 2, 4 and 6 offset from one another in the vertical direction as shown in FIGS. 1 and 2. When sidewalls 3 and 5 are arranged as shown in the figures, the pairs of slots on sidewall member 3 are aligned with corresponding pairs of slots on sidewall member 5 such that support members 7–12 can extend between and engage the slots, as will hereinafter we described.

Figure 3:
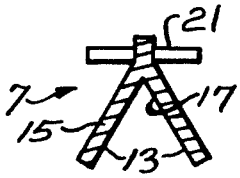
FIG. 3 shows a section view taken along line 3—3 of FIG. 2.

The support members 7–12 are identical to one another in construction and operation such that specific reference will be made only to support member 7, best shown in FIGS. 2 and 3. Horizontal support member 7 consists of an elongated V-shaped recess 13 having a length equal to or greater than the length of typical household wrap carton. The V-shaped recess 13 consists of a first wall 15 and a second wall 17 arranged at an acute angle with respect to one another such that one corner of a wrap carton can be received therein. Extending from the V-shaped recess 13 at opposite ends thereof are a pair of flanges 21 and 23. Flanges 21 and 23 are connected to and spaced from the V-shaped recess 13 by spacer elements 25 and 27, respectively, dimensioned such that the space between the flanges 21 and 23 and the V-shaped recess 13 is approximately equal to or slightly less than the thickness of the sidewalls 3 and 5.

To assemble the wrap holder of the invention, the sidewalls 3 and 5 are arranged so as to be parallel with respect to one another with the pairs of slots on sidewall 3 being aligned with corresponding pairs of slots on sidewall 5. The horizontal support members 7–12 are fixed to the sidewalls 3 and 5 by inserting flanges 21 and 23 through the slots and rotating the support members such that the flanges extend across the slots, as shown in FIG. 1. Thus, the support members 7–12 cannot be removed from the slots. Because the length of spacer elements 25 and 27 is equal to or slightly less than the width of the sidewalls 3 and 5, the horizontal support members 7–12 will be held in position relative to the sidewalls by the friction fit created by the engagement of the ends of walls 15 and 17 and the flanges 21 and 23 with the sidewalls 3 and 5. The support members 7–12 are arranged such that the V-shaped recesses of the support members located in the pairs of slots face one another to receive and retain the opposite corners of a carton therebetween. The cartons are arranged between the support members such that the serrated cutting blades of the cartons are presented in a plane where the severing of the wrap is facilitated. The support members 7–12 can be slid in the slots in the vertical direction relative to one another to accommodate wrap cartons of various sizes as illustrated in FIG. 1. As previously described, the pairs of slots are offset from one another as shown in FIGS. 1 and 2 such that adjacent cartons will also be offset from one another to prevent the adjacent cartons from interfering with the dispensing of the wrap paper.

While the preferred embodiment of this invention has been shown and described in some detail, it is to be understood by one of ordinary skill in the art that this description and the accompanying drawings are offered merely by way of example, and that the invention is to be limited in scope only by the appended claims.

What is claimed is:

1. A holder for household wrap cartons comprising:

(a) first and second sidewalls having portions defining a plurality of elongated slots, said slots on the first sidewall having corresponding slots on the second sidewall; and (b) a plurality of identical support members including means for engaging a corner of said cartons consisting of V-shaped members having recesses for engaging the corners of a wrap carton and means engageable with said slots for allowing said support members to slide in said slots relative to said sidewalls, said support members extending between the corresponding slots on the first and second sidewalls and being arranged in opposed pairs such that the recesses of the V-shaped members of the opposed pairs of support members face each other and can be moved into and out of engagement with opposite corners of the carton to retain a carton between the opposed pairs of support members by sliding the means engageable with said slots along said slots.

2. The holder according to claim 1, wherein said means engageable with said slots includes flanges spaced from said Vshaped members for extending through said slots formed in said sidewalls such that the sidewalls are frictionally engaged between said flanges and said V-shaped members.

3. The holder according to claim 1, wherein each of said plurality of support members engages only one carton.

4. A holder for household wrap cartons of the type having a roll of wrap paper contained in the carton, the carton having an opening for removing the wrap paper and a device for severing the wrap paper from the roll, comprising:

(a) first and second planar sidewalls having portions defining a plurality of slots extending through the sidewalls where the slots formed in the first sidewall have corresponding slots formed in the second sidewall, said slots being elongated along a first direction;

(b) a plurality of support members extending between the sidewalls and having means extending therefrom for extending through said slots and frictionally engaging said sidewalls to fix the support member relative to the sidewalls in all directions except the first direction, the support members extending between corresponding slots on the first and second sidewalls; said support members including means for engaging a corner of the carton consisting of V-shaped members having a recess for engaging the corners of a wrap carton and being arranged in opposed pairs such that the recesses of the V-shaped members of the opposed pairs of support members face each other and can be moved towards and away from one another along the first direction to releasably engage opposite corners of a carton to retain the carton such that the device for severing the wrap paper is oriented so as to allow the wrap paper to be severed while the carton is retained by the support members.

5. The holder according to claim 4, wherein said plurality of support members are identical to one another.

* * * * *